US007084562B2

(12) United States Patent
Kurachi et al.

(10) Patent No.: US 7,084,562 B2
(45) Date of Patent: Aug. 1, 2006

(54) ELECTRODELESS DISCHARGE LAMP

(75) Inventors: Toshiaki Kurachi, Hirakata (JP); Satoshi Kominami, Katano (JP); Kiyoshi Hashimotodani, Takatsuki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/940,044

(22) Filed: Sep. 14, 2004

(65) Prior Publication Data

US 2005/0057186 A1 Mar. 17, 2005

(30) Foreign Application Priority Data

Sep. 16, 2003 (JP) ..... 2003-323235

(51) Int. Cl.
*H01J 63/04* (2006.01)

(52) U.S. Cl. ..... 313/493

(58) Field of Classification Search ..... 313/492, 313/493, 485, 246, 248, 318.01, 318.05; 315/291, 307, DIG. 7
See application file for complete search history.

(56) References Cited

U.S. PATENT DOCUMENTS

| | | | | |
|---|---|---|---|---|
| 4,704,562 | A | 11/1987 | Postma et al. | |
| 5,461,284 | A | 10/1995 | Roberts et al. | |
| 5,539,283 | A * | 7/1996 | Piejak et al. | 315/248 |
| 5,668,433 | A | 9/1997 | Everest et al. | |
| 5,798,618 | A * | 8/1998 | van Os et al. | 315/248 |
| 6,650,068 | B1 * | 11/2003 | Kurachi et al. | 315/248 |
| 6,653,783 | B1 * | 11/2003 | Kawasaki et al. | 313/609 |
| 6,768,254 | B1 * | 7/2004 | Kawasaki et al. | 313/493 |

* cited by examiner

*Primary Examiner*—Shih-Chao Chen
*Assistant Examiner*—Minh Dieu A
(74) *Attorney, Agent, or Firm*—Akin Gump Strauss Hauer & Feld, LLP

(57) ABSTRACT

An electrodeless discharge lamp is disclosed that comprises a bulb with a substance for electric discharge sealed therein, the bulb having a reentrant portion protruding inwardly along a Z-axis direction; an induction coil arranged in the reentrant portion, the induction coil having a magnetic core and a winding wound around the magnetic core; and a drive circuit for supplying the induction coil with a power from 50 kHz to 1 MHz. The bulb has an outer diameter from 65 mm to 75 mm in a direction orthogonal to the Z-axis direction, and the magnetic core has a length L in the Z-axis direction that is 1.05 times or more a length L' of the winding in the Z-axis direction, the length L being set to 41 mm or less.

17 Claims, 8 Drawing Sheets

FIG. 3A

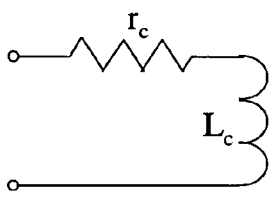

$r_c$ : Resistance of Induction Coil
$L_c$ : Inductance of Induction Coil

Equivalent Circuit of Induction Coil Alone

FIG. 3B

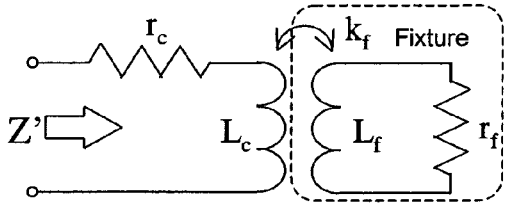

$r_c$: Resistance of Induction Coil
$L_c$: Inductance of Induction Coil
$L_f$: Self-Inductance of Fixture
$r_f$: Resistance of Fixture
$k_f$: Coefficient of Coupling between Fixture and Induction Coil Equivalent Circuit Including Mutual Induction Between Induction Coil And Fixture

FIG. 4

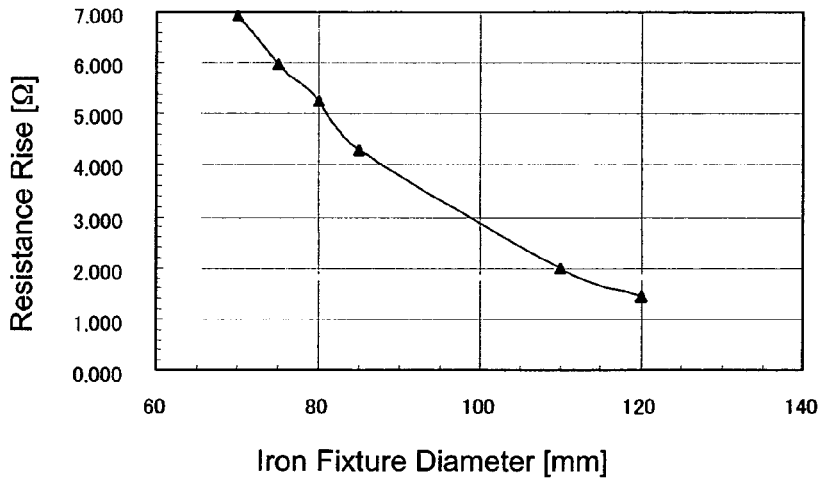

ELECTRODELESS DISCHARGE LAMP

BACKGROUND OF THE INVENTION

1. Field of the Invention

The present invention relates to an electrodeless discharge lamp that emits light under an electromagnetic field generated by an induction coil arranged in a reentrant portion of a bulb.

2. Description of the Related Art

Recent years have seen a widespread use of fluorescent lamps with higher efficiency and longer life than electric bulb from the viewpoint of global environmental protection. Further, in addition to conventional fluorescent lamps comprising electrodes, electrodeless lamps are under research. Having no electrodes—a factor restricting the life of conventional lamps with electrodes, electrodeless lamp has the advantage that its life is several times longer than that of lamps with electrode, thus holding promise for future widespread use.

Such an electrodeless lamp produces a discharge plasma with a high-frequency electromagnetic field generated by an induction coil arranged in a reentrant portion of a bulb. Having a shape of solenoid of a finite length, the induction coil forms an open magnetic circuit, causing the magnetic field to leak out of the induction coil.

To prevent the magnetic field from leaking out of the induction coil, Japanese Patent Application Laid-Open Publication No. 1995-262972 teaches using a short-circuited metal ring shown in FIG. 13. According to the teaching, a short-circuited metal ring 9 is arranged on the outer perimeter surface of a bulb 1, and as substantially all magnetic fields generated from the induction coil 3 induce current within the metal ring 9, magnetic flux leaking out of the lamp is suppressed, thus suppressing fixture interference. This ensures that there are substantially no changes between when the lamp is attached and when it is not attached to metallic fixture (see, e.g., Japanese Patent Application Laid-Open Publication No. 1995-262972).

The present inventors have found that when an electrodeless lamp operates on power at a relatively low driving frequency (e.g., 1 MHz or less), provision of a short-circuited metal ring as disclosed in Japanese Patent Application Laid-Open Publication No. 1995-262972 near the bulb will considerably reduce the starting pulse voltage generated in the induction coil during lamp startup, making it difficult, in the worst case, to start the lamp and maintain it lit. The present inventors have also discovered that, even in the absence of such a metal ring, a similar problem will arise if the electrodeless lamp is used as attached to metallic lighting fixture, etc.

Thus, in the presence of a metal ring such as short-circuited metal ring or lighting fixture near the electrodeless lamp, the starting pulse voltage generated in the induction coil will decline considerably, making it difficult, in the worst case, to start the lamp and maintain it lit. In the present specification, this phenomenon is referred to as "fixture interference." The reason why fixture interference occurs is deemed to be attributable to mutual induction occurring between the induction coil and the metal ring as a result of crossing of leaked magnetic field with the metal ring. That is, if the winding of the induction coil is assumed to be the primary winding of the coil magnetic core, the metal ring such as a short-circuited ring or a lighting fixture is equivalent to the secondary winding of the coil magnetic core. If the resistance value of the metal ring is sufficiently reduced to minimize losses in the metal ring, the Q value of the induction coil will decline considerably. On the other hand, if the distance is close between the metal portion of the lighting fixture and the induction coil, mutual induction will unavoidably increase, reducing the Q value of the induction coil. This results in difficulties in generation of the starting voltage at both ends of the induction coil—a voltage required to initiate electric discharge, possibly deteriorating the startability of the lamp.

Thus, depending on the magnitude of mutual inductance in fixture interference, the starting pulse voltage, generated in the induction coil during lamp startup, will decrease considerably, making it difficult, in the worst case, to start the lamp and keep it lighting.

As described earlier, this problem of lamp startability is prominent if the high-frequency power used for discharge is low in frequency (driving frequency). The reason is that electric discharge readily occurs at a high driving frequency, making decline in Q value of the induction coil trivial. Currently under research is further reduction in frequency of high-frequency power used for electric discharge. For this reason, the demands are high for development of a technology for avoiding decline in Q value of the induction coil caused, for example, by fixture interference.

SUMMARY OF THE INVENTION

In light of the above, the present invention was conceived. It is therefore an object to provide an electrodeless discharge lamp that offers reduced fixture interference while securing lamp startability by maintaining the induction coil at a high Q value.

An electrodeless discharge lamp according to a first aspect of the present invention comprises: a bulb including a substance for electric discharge sealed therein. The bulb has an outer diameter from 65 mm to 75 mm in a direction orthogonal to a given direction, and has a reentrant portion protruding inwardly along the given direction. The discharge lamp further comprises an induction coil arranged in the reentrant portion, and a drive circuit for supplying the induction coil with a power from 50 kHz to 1 MHz. The induction coil has a magnetic core and a winding wound around the magnetic core. The magnetic core has a length L in the given direction that is 1.05 times or more a length L' of the winding in the given direction, the length L being set to 41 mm or less.

In a preferred embodiment, the length L of the magnetic core is 1.07 times or more the length L' of the winding, the length L being set to 39 mm or less.

In a preferred embodiment, the length L of the magnetic core is set to 15 mm or more.

In a preferred embodiment, the bulb has a shape substantially axially symmetrical with respect to the given direction.

An electrodeless discharge lamp according to a second aspect of the present invention comprises: a bulb including a substance for electric discharge sealed therein. The bulb has an outer diameter from 65 mm to 75 mm in a direction orthogonal to a given direction, and has a reentrant portion protruding inwardly along the given direction. The discharge lamp further comprises an induction coil arranged in the reentrant portion, and a drive circuit for supplying the induction coil with power from 50 kHz to 1 MHz. The coil has a magnetic core and a winding wound around the magnetic core. The induction coil has a Q value of 100 or more as measured with the induction coil positioned at the center in an iron-made cylinder having the diameter of 85 mm.

In a preferred embodiment, the distance between the centers of the winding and of the magnetic core is 1 mm or less.

In a preferred embodiment, the axial length of the winding is 38 mm or less.

In a preferred embodiment, the frequency of power supplied by the drive circuit is from 100 kHz to 700 kHz.

In a preferred embodiment, the winding is made of litz wire.

In a preferred embodiment, the sealed gas is krypton gas or a mixed gas of argon and krypton gases sealed in a pressure range from 40 Pa to 250 Pa.

In a preferred embodiment, the lamp further comprise a screw base for receiving commercial power, the electrodeless discharge lamp having a shape in the form of an electric bulb.

It is possible according to the present invention to provide an electrodeless discharge lamp that reduces the effect of interference while securing lamp startability by maintaining a high Q value of the induction coil. It is also possible to not only lighten the total weight of the lamp but also minimize the magnetic core cost by restricting the axial length of the magnetic core to the minimum required size.

BRIEF DESCRIPTION OF THE DRAWINGS

The above and other objects, aspects, features and advantages of the present invention will become more apparent from the following detailed description when taken in conjunction with the accompanying drawings, in which:

FIGS. 3A and 3B show equivalent circuits of an induction coil according to the embodiment of the present invention;

FIG. 4 is a graph showing an example of characteristics of the induction coil resistance value according to the embodiment of the present invention;

DESCRIPTION OF THE PREFERRED EMBODIMENT

An embodiment of an electrodeless discharge lamp according to the present invention will now be described with reference to the accompanying drawings.

Figure 1:
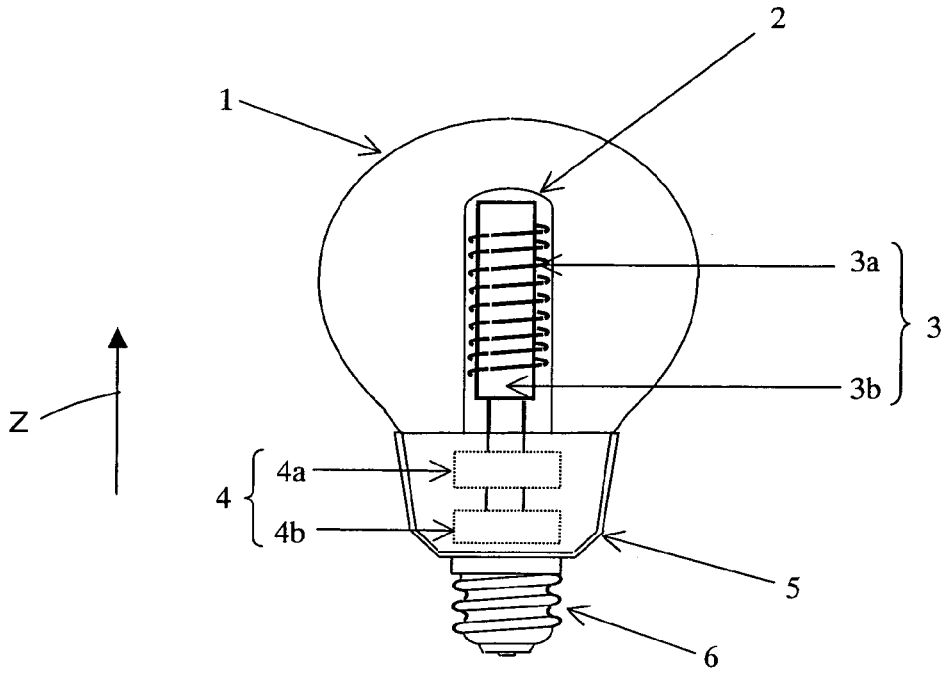
FIG. 1 is a schematic view of an electrodeless discharge lamp according to an embodiment of the present invention.

First, a reference will be made to FIG. 1. FIG. 1 shows a configuration of an electrodeless discharge lamp according to the present embodiment. The lamp according to the present embodiment includes a bulb (envelope) 1 made of a translucent substance such as soda glass. A substance for electric discharge is sealed within the bulb 1. In the present specification, a substance for electric discharge refers to a substance that produces radiation at a given wavelength as a result of electric discharge. While being typically a mixture of various gases, electric discharge substance may contain a substance in liquid phase at normal temperature as long as it transforms into a gaseous phase during lamp operation. While a preferred example of electric discharge substance sealed within the bulb 1 is a mixture of mercury and rare gas (e.g., argon gas), electric discharge substance is not necessarily limited thereto.

There is formed a phosphor layer, not shown, on the inner surface of the bulb 1, converting ultraviolet light produced by the electric discharge gas within the bulb 1 into visible light. The phosphor layer is formed by coating the inner surface of the bulb 1 with a phosphor.

The bulb 1 has a reentrant portion 2. The reentrant portion 2, provided at part of the wall of the bulb 1, is a tubular portion protruding in the Z-axis direction in FIG. 1 from the bottom of the bulb 1 toward the inside thereof. In the present specification, the Z-axis direction is referred to as axial direction. The bulb 1 of the present embodiment has a shape symmetrical with respect to the Z-axis direction. There is an induction coil 3 inserted into the reentrant portion 2 from outside the bulb 1. Here, the inside of the reentrant portion 2 does not communicate with the inside of the bulb 1, making the inside of the reentrant portion 2 a space not in contact with the electric discharge substance sealed within the bulb 1. The inside of the reentrant portion 2 is, in this sense, located in the space outside the closed bulb 1.

The induction coil 3 comprises a magnetic core 3*b*, in substantially cylindrical form, and a winding 3*a*, wound in solenoid form around the outer perimeter of the magnetic core 3*b*. The size of the magnetic core 3*b* in the Z-axis direction (axial length) is represented by "L", whereas the size of the winding 3*a* in the Z-axis direction (axial length) is represented by "L'." It is to be noted that the axial length L of the magnetic core 3*b* is occasionally referred to as the "height" or "core length" of the magnetic core 3*b*, and that the axial length L' of the winding 3*a* is occasionally referred to as the "axis length" of the winding.

The winding 3*a* is connected to a drive circuit 4 for supplying the induction coil 3 with high-frequency current. Being provided with a high-frequency circuit 4*b* and a matching circuit 4*a* for matching impedance between the induction coil 3 and the high-frequency circuit 4*b*, the drive circuit 4 is covered by a case 5. The case 5 is formed from a heat-resistant plastic with high electrical insulation property (e.g., polybutylene terephthalate). Power input to the drive circuit 4 is supplied via a screw base 6.

A description will be given next of the operation of the electrodeless discharge lamp shown in FIG. 1.

The high-frequency circuit 4*b* operates on power supplied from the screw base 6. The high-frequency circuit 4*b* converts commercial frequency power to high-frequency ac power, for example, from 50 kHz to 1 MHz. A high-frequency ac current, converted by the high-frequency circuit 4*b* so as to have a proper frequency, is supplied to the induction coil 3 via the matching circuit 4*a*. Once the induction coil 3 is supplied with high-frequency power, a magnetic field is generated from the induction coil 3. This magnetic field generates an induction electric field within the bulb 1, thus forming an electric discharge plasma within the bulb 1.

Within the electric discharge plasma formed inside the bulb 1, mercury is excited, producing ultraviolet radiation. Ultraviolet light radiated from mercury is converted to visible light by the phosphor layer formed on the inner surface of the bulb 1, radiating visible light externally through the outer surface of the bulb 1. This light emission principle itself is the same as that used in the prior art technology.

A description will be given next of fixture interference in the lamp according to the present embodiment.

Figure 2:
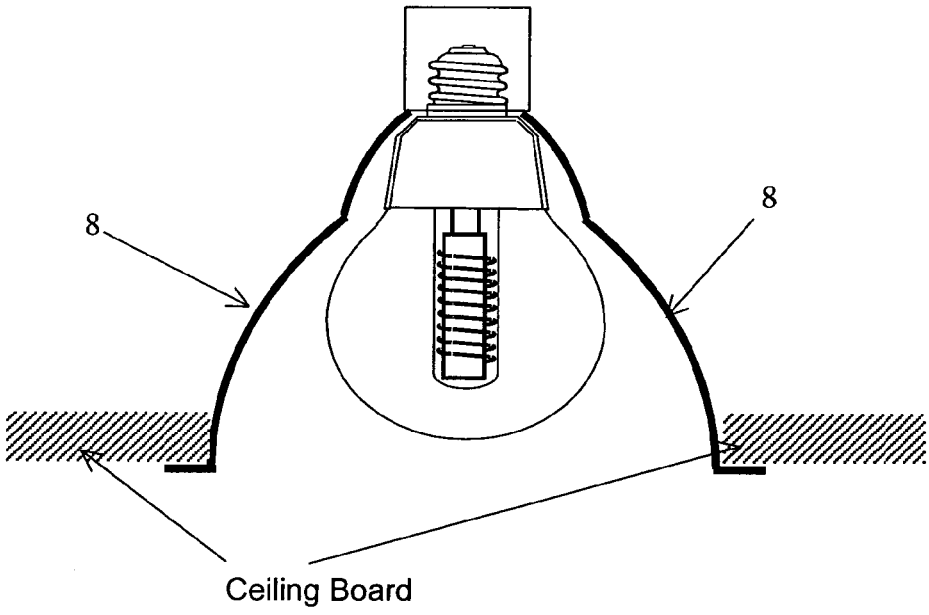
FIG. 2 is a sectional view of metal fixture according to the embodiment of the present invention.

As shown in FIG. 1, the electrodeless discharge lamp formed in the shape of an electric bulb is generally used as replacement for incandescent electric bulb. For this reason, the lamp according to the present embodiment can be used for ceiling-embedded type metallic downlighting fixture as shown in FIG. 2. Such downlighting fixture is provided with a metal reflecting mirror 8 so as to effectively extract lamp light toward the direction of the floor.

In the presence of metal fixture such as the reflecting mirror 8 near the electrodeless discharge lamp, the magnetic field generated by the induction coil 3 spreads outside the lamp, causing the magnetic field to cross the reflecting mirror 8. Since the reflecting mirror 8 functions as a single-turn short-circuited ring wound with a distance from the magnetic core 3*b*, the winding 3*a* and the reflecting mirror 8 will eventually be equivalent to primary and secondary windings wound around the magnetic core 3*b*, respectively. For this reason, mutual induction will occur between the induction coil 3 and the reflecting mirror 8.

FIG. 3A shows an equivalent circuit of the induction coil 3, whereas FIG. 3B shows an equivalent circuit when mutual induction is present between the induction coil 3 and the reflecting mirror 8. The portion enclosed by a dotted line in FIG. 3B is the portion equivalent to the metal reflecting mirror 8.

Solving for an apparent input impedance Z' of the induction coil 3, based on the equivalent circuit in FIG. 3B, yields an equation of Equation 1.

$$Z' = \left[r_c + \frac{\omega^2 M^2}{r_f^2 + \omega^2 L_f^2} r_f\right] + j\omega\left[L_c - \frac{\omega^2 M^2}{r_f^2 + \omega^2 L_f^2} L_f\right] \quad \text{<Equation 1>}$$

Where ω is a driving frequency (value converted to each frequency), j a complex number, M mutual inductance, $r_c$ a resistance of the induction coil, $L_c$ an inductance of the induction coil, $L_f$ a self-inductance of the fixture, and $r_f$ a resistance of the fixture. A coefficient $k_f$ of coupling between the fixture and the induction coil, which equals to $M/(L_c L_f)^{1/2}$, is used to give Equation 1.

It is clear from Equation 1 that, as a result of effect of mutual inductance, the real number part of the input impedance Z' has increased considerably from the resistance $r_c$ of the induction coil prior to fixture insertion.

Next, a prototype of the induction coil 3 was made in which the winding 3*a* in solenoid form was arranged around the magnetic core 3*b* formed from a cylindrical ferrite (initial permeability: 2300). The cylindrical ferrite used for the magnetic core 3*b* had the inner diameter of 8.5 mm, outer diameter of 13.5 mm and axial length L of 160 mm, with an initial permeability of 2300. On the other hand, the winding 3*a* was provided by axially arranging 50 turns of litz wire, formed by bundling 28 thin wires of 0.08 mm in diameter, in solenoid form within a 24 mm-area. That is, the axial length L' of the winding 3*a* was 24 mm. The central axes of the magnetic core 3*b* and the winding 3*a* were matched with each other. Here, litz wire was used for the winding 3*a* to suppress the impact of proximity effect of the winding, thus allowing reducing the winding resistance as compared with when a single wire is used.

FIG. 4 is a graph showing an apparent rise in resistance relative to the resistance of the induction coil 3 having the above configuration when the induction coil 3 is inserted into an iron-made cylinder. Here, the "iron-made cylinder (iron fixture)" is equivalent to the metal reflecting mirror 8 shown in FIG. 2.

In contrast with the resistance of the induction coil 3 measured to be 1.48 Ω when the coil was not inserted in the iron fixture, the resistance of the induction coil 4 rose 4.3 Ω when the coil was inserted in the iron fixture of 85 mm in diameter as shown in FIG. 4.

This increase in resistance is accompanied by a considerable decline in Q value of the induction coil 3, for example, from 356 to 80 at a driving frequency of 500 kHz. As the Q value of the induction coil 3 declines, the starting voltage generated in the induction coil 3 during lamp startup undergoes an abrupt decline, possibly resulting in an inconvenience—difficulties in starting the lamp. This point will be described in detail later.

The inventors of the present application have thought out the present invention upon discovering that it is possible to suppress rise in resistance of the induction coil 3 as a result of the aforementioned mutual induction by shortening the axial length L of the magnetic core 3*b*. It was conventionally known that, in a condition where mutual induction need not be considered, the greater the axial length L of the magnetic core 3*b*, the greater the Q value. For this reason, it is expectable, in a case where mutual induction should be considered, that increasing the axial length L of the magnetic core 3*b* would enhance the startability of the lamp. In fact, contrary to expectation, however, it has been found that reducing the axial length L of the magnetic core conversely will enhance the startability of the lamp. This point will be described below.

Figure 14:
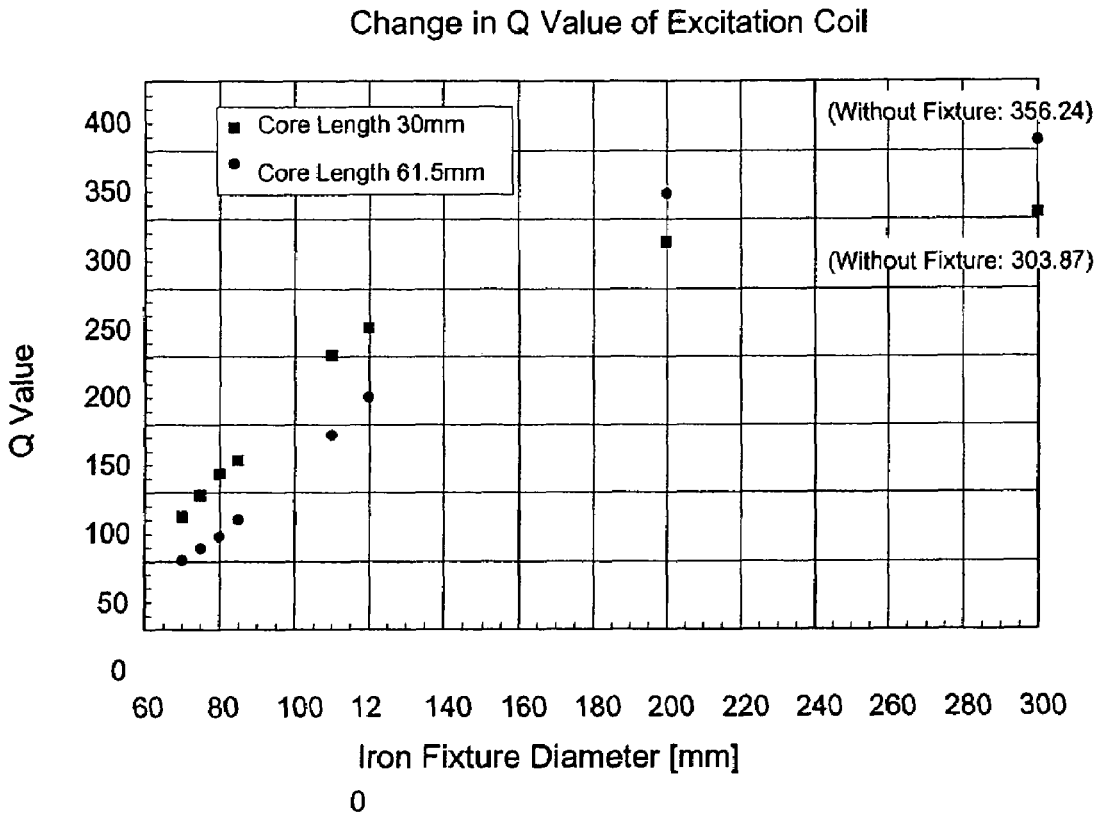
FIG. 14 is a graph showing the relationship between the Q value of the induction coil and the diameter of the iron fixture in the electrodeless discharge lamp having the magnetic cores of different lengths.

FIG. 14 is a graph showing dependency of the Q value of the induction coil 3 on the diameter of the iron fixture. "Without fixture" in the graph of FIG. 14 means that there is no iron fixture. More specifically, this represents a condition in which no interference occurs with the iron fixture thanks to a sufficiently large diameter of the iron fixture. In the graph, when the diameter of the iron fixture is 300 mm, fixture interference is ignorable. Therefore, the Q value at this time can be assumed to be a Q value "without fixture."

As is clear from the graph of FIG. 14, the greater the axial length L of the magnetic core 3*b* ("core length" in FIG. 14), the greater the Q value in the case "without fixture." However, the smaller the iron fixture becomes in diameter, the greater the effect of interference becomes, thus reversing the situation. That is, in a situation where fixture interference takes place, the greater the axial length L of the magnetic core 3*b* ("core length" in FIG. 14), the smaller the Q value becomes. This fact has been previously unknown, and the present invention has been made based on this discovery.

Figure 5:
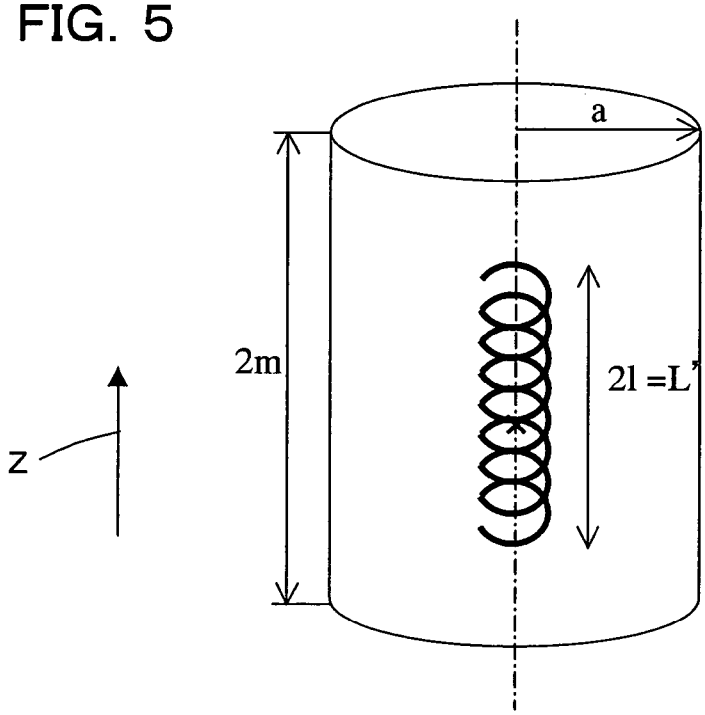
FIG. 5 is a perspective view showing an analysis model according to the embodiment of the present invention.

FIG. 5 shows a model used to analyze mutual inductance between the induction coil 3 and the reflecting mirror 8. As shown in FIG. 5, the induction coil 3 and the reflecting mirror 8 are arranged concentrically. Mutual inductance M between the two is theoretically expressed by the following equation:

$$M = \frac{\mu S n}{2m}\left[\sqrt{a^2 + (m+l)^2} - \sqrt{a^2 + (m-l)^2}\right] \quad \text{<Equation 2>}$$

Where μ indicates permeability, "a" a diameter of the cylinder equivalent to the metal reflecting mirror 8, m half the axial length of the cylinder, S a cross-sectional area of the winding 3*a* and I half the axial length of the winding 3*a*.

It is clear from the above theoretical equation that the smaller the axial length L' of the winding 3*a* (=2I) is made, the smaller the mutual inductance M becomes. However, since a strong plasma is produced in regions immediately beside the winding 3*a*, the smaller the axial length L' of the winding is made, the smaller the plasma height (axial size) becomes. As a result, the plasma density increases excessively, possibly adversely affecting electric discharge efficiency. In addition, uneven brightness may occur due to plasma concentration in only part of the bulb 1. It is preferred, in consideration thereof, that the axial length L of the magnetic core 3*b* alone be changed while avoiding to shorten the length L' of the winding 3*a*.

Figure 6:
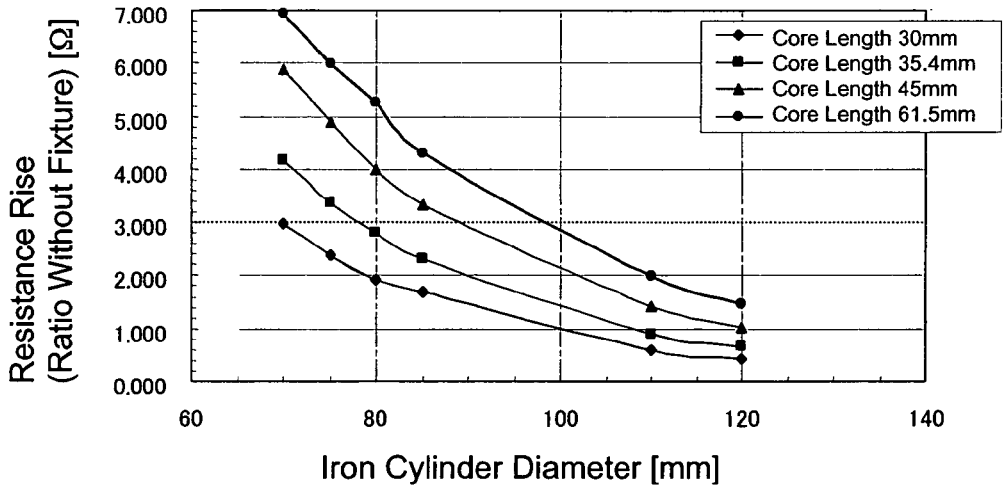
FIG. 6 is a graph showing an example of characteristics of the induction coil resistance value according to the embodiment of the present invention.

FIG. 6 is a graph showing the relationship between rise in resistance of the induction coil 3 and the iron cylinder diameter regarding the plurality of magnetic cores 3*b* having the different axial lengths L. The winding 3*a* used to obtain the graph of FIG. 6 was formed from litz wire in which 28 thin wires of 0.08 mm in diameter were bundled, with the axial length L' of the winding 3*a* fixed to 24 mm. The inner and outer diameters of the magnetic core 3*b* were set respectively to 8.5 mm and 13.5 mm, and the axial length L thereof alone was changed to 30 mm, 35.4 mm, 45 mm and 61.5 mm.

As is clear from FIG. 6, the smaller the axial length L of the magnetic core 3*b* ("core length" in FIG. 6), the better it is possible to suppress rise in resistance of the induction coil 3 (rise in input impedance). That is, the closer the axial length L' of the winding 3*a* becomes to the axial length (core length) L of the magnetic core 3*b*, the more suppressed the rise in resistance of the induction coil 3.

Thus, the axial length L of the magnetic core 3*b* has a large impact on the resistance of the induction coil 3. A description will be given below of the lower and upper limits of the axial length L of the magnetic core 3*b* regarding a preferred range thereof.

First, the lower limit of the axial length L of the magnetic core 3*b* will be described. The following inconvenience will arise if the axial length L of the magnetic core 3*b* is shorter than the axial length L' of the winding 3*a*. That is, there occurs a case where, due to variations in the axial length L of the magnetic core 3*b*, the winding 3*a*, wound around the edge portion of the magnetic core 3*b*, is in the coreless state or has the magnetic core 3*b*. In the event of such variations, the inductance of the induction coil 3 undergoes a considerable change. If the inductance of the induction coil 3 changes considerably, the load circuit of the drive circuit 4 comprising the matching circuit 4*a* and the induction coil 3 has a large variation, resulting in extreme difficulties in designing the drive circuit 4. It is always necessary, for this reason, to make the axial length L of the magnetic core 3*b* longer than the axial length L' of the winding 3*a*.

Magnetic core such as ferrite is generally formed by sintering magnetic powder at high temperatures. Contraction coefficient during sintering varies depending, for example, on variations in powder charging rate and humidity during powder pressing, as a result of which the axial length of the magnetic core after sintering has a variation of approximately ±5%. Consequently, it is necessary to set the axial length L of the magnetic core 3*b* to 1.05-fold or greater than the axial length L' of the winding 3*a*. Further, it is preferred, in consideration of variations during assembly of the induction coil 3, that the axial length L of the magnetic core 3*b* be set to 1.07-fold or greater than the axial length L' of the winding 3*a*. On the other hand, since inconvenience arises as described earlier if the axial length L' of the winding 3*a* is excessively short, it is preferred that the lower absolute limit of the axial length L of the magnetic core 3*b* be set to 15 mm or more.

It is to be noted that the total lamp length is, in consideration of the size of currently marketed electric bulb type fluorescent lamps, preferred to be about 140 mm at longest. It is preferred that the light emitting portion (portion where the bulb 1 is exposed) account for 50% or more of the total length. On the other hand, if a distance of 10 mm or more is secured between the upper end of the reentrant portion 2 and the upper end of the bulb 1, it is possible to ensure that the shadow of the reentrant portion 2 is invisible from the top portion of the bulb 1. Considering these aspects, it is preferred that the axial length L of the magnetic core 3*b* be set to 60 mm or less. To make the axial length L of the magnetic core 3*b* 60 mm or less, it is necessary to make the axial length L' of the winding 3*a* 56 mm or less. It is to be noted, however, that, in consideration of mutual induction with the metal reflecting mirror, the axial length L of the magnetic core 3*b* is preferred to be set further shorter (more specifically 41 mm or less).

Figure 7:
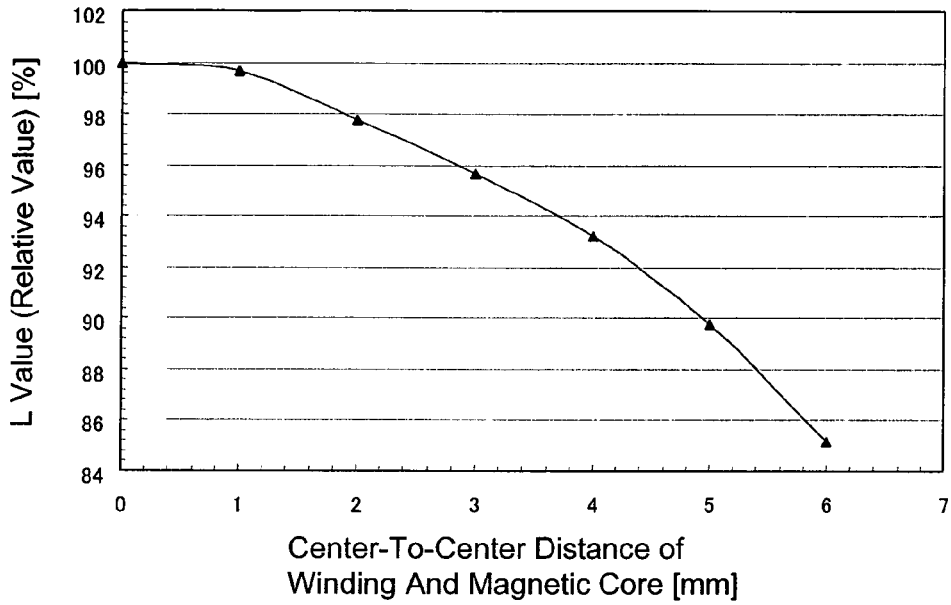
FIG. 7 is a graph showing the relationship between the center-to-center distance of a magnetic core and winding and the inductance according to the embodiment of the present invention.

FIG. 7 is a graph showing the relationship between the center-to-center distance of the winding 3*a* and the magnetic core 3*b* (displacement in the direction of longer axis) and the inductance (L value) of the induction coil 3. It is to be noted that the central axis of the winding 3*a* is matched with that of the magnetic core 3*b*. The size of the magnetic core 3*b* is 8.5 mm in inner diameter, 13.5 mm in outer diameter and 30 mm in the axial length L. The axial length L' of the winding 3*a* is 24 mm.

As is clear from FIG. 7, the inductance of the induction coil 3 has a tendency to decline with increased vertical displacement between the centers of the winding 3*a* and the magnetic core 3*b*. Decline in inductance means decline in magnetic flux generated by application of a constant magnetomotive force to the winding 3*a*. Since inductance is desired to be as high a value as possible, it is preferred that the centers of the winding 3*a* and the magnetic core 3*b* be matched with or close to each other. More specifically, it is preferred that the center-to-center distance be set to 1 mm or less.

On the other hand, if the length of the magnetic core 3*b* becomes the shortest within the dimensional tolerance as described earlier, it is necessary to ensure that the end portion of the winding 3*a* is not coreless. To tolerate a 1 mm displacement between the center positions of the winding 3*a* and the magnetic core 3*b*, therefore, it is preferred that the length of the magnetic core 3*b* be designed 1.05-fold plus 1 mm or greater than the axial length of the winding 3*a*. Further, in consideration of variations during assembly of the induction coil 3, it is preferred that the length of the magnetic core 3*b* be designed 1.07-fold plus 1 mm or greater than the axial length of the winding 3*a*.

The upper limit of the axial length L of the magnetic core 3*b* will be described next.

As described earlier, the smaller the axial length L of the magnetic core 3*b*, the better it is possible to suppress rise in resistance caused by mutual inductance with the reflecting mirror 8. But nevertheless, the greater the axial length L becomes, the easier it becomes to suppress variations in inductance caused by variations during assembly of the induction coil 3. It is possible, considering these points, to determine the upper limit of the axial length L of the magnetic core 3*b* by the tolerance limit of resistance rise.

Figure 8:
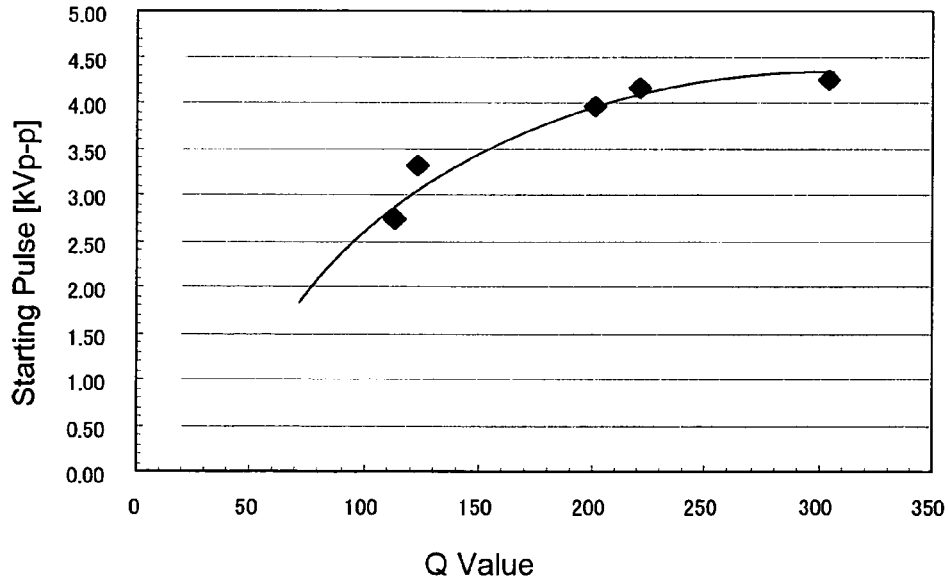
FIG. 8 is a graph showing the relationship between the Q value of the induction coil and the starting pulse according to the embodiment of the present invention.

FIG. 8 shows the relationship between the starting pulse, generated in the induction coil 3 during lamp startup, and the Q value of the induction coil 3 when the lamp according to the present invention is inserted into an iron cylinder of 85 mm in diameter. This relationship is a graph obtained from simulation using a circuit simulator. Here, the driving frequency of the drive circuit 4 was set to 480 kHz.

As is clear from the graph of FIG. 8, as the Q value of the induction coil 3 declines, the starting pulse declines. For this reason, it is necessary to find the tolerance range of the Q value from the threshold value of the starting pulse required for initiating electric discharge of the bulb 1.

Table 1 given below shows the relationship between the electric discharge gas pressure and the pulse voltage required for initiating electric discharge.

TABLE 1

| Gas type | Gas pressure [Pa] | Bulb outer dia. [mm] | Freq. [kHz] | Power [W] | Starting vol. [kVp-p] |
|---|---|---|---|---|---|
| Kr | 195 | 65 | 450 | 12 | 2.50 |
| Kr | 220 | 65 | 450 | 12 | 2.54 |
| Kr | 250 | 65 | 450 | 12 | 2.54 |
| Kr | 195 | 65 | 300 | 12 | 2.58 |
| Kr 80%, Ar 20% | 195 | 65 | 480 | 12 | 2.54 |
| Kr 80%, Ar 20% | 195 | 65 | 700 | 12 | 2.58 |
| Kr 80%, Ar 20% | 195 | 65 | 1000 | 12 | 2.50 |
| Kr 80%, Ar 20% | 40 | 70 | 480 | 20 | 2.61 |
| Kr 80%, Ar 20% | 60 | 70 | 480 | 20 | 2.53 |
| Kr 80%, Ar 20% | 80 | 70 | 480 | 20 | 2.52 |
| Kr 80%, Ar 20% | 100 | 70 | 480 | 20 | 2.54 |

It is to be noted that the outer diameter of the bulb 1 was set to 65 mm and 75 mm in the direction vertical to the axial direction (Z-axis direction in FIG. 1). The reason for this is that 65 mm and 75 mm are equivalent to the lower and upper limits of the outer diameter of a practical bulb. On the other hand, the inner diameter of the reentrant portion 2 was set to 19 mm, whereas the driving frequency of the drive circuit 4 was set to 480 kHz. The induction coil 3 comprised the magnetic core 3*b* made of a cylindrical ferrite having the inner diameter of 8.5 mm, outer diameter of 13.5 mm and axial length of 45 mm, and the winding 3*a* in which 50 turns of litz wire, formed by bundling 28 thin wires of 0.08 mm in diameter, were arranged.

The reason for selecting the electric discharge gas pressure of 40 Pa to 250 Pa as shown in Table 1 is that if the electric discharge gas pressure is 40 Pa or less, it is necessary to supply extremely large power in order to maintain electric discharge and that the pressure of 250 Pa or more can considerably reduce light emission efficiency. Therefore, the range from 40 Pa to 250 Pa is believed to be a practical pressure range for configuring a self-ballasted electrodeless lamp.

When krypton gas or a mixed gas of argon and krypton gases is used at a pressure from 40 Pa to 250 Pa, the voltage of the induction coil 3 required to initiate electric discharge in all bulbs remains almost constant in the neighborhood of 2.5 kV as is clear from Table 1. Based on the graph of FIG. 8, the Q value range, required to secure the voltage of 2.5 kV or more generated in the induction coil 3 during startup, is 100 or more. For this reason, it is preferred to ensure that the Q value becomes 100 or more.

Figure 9:
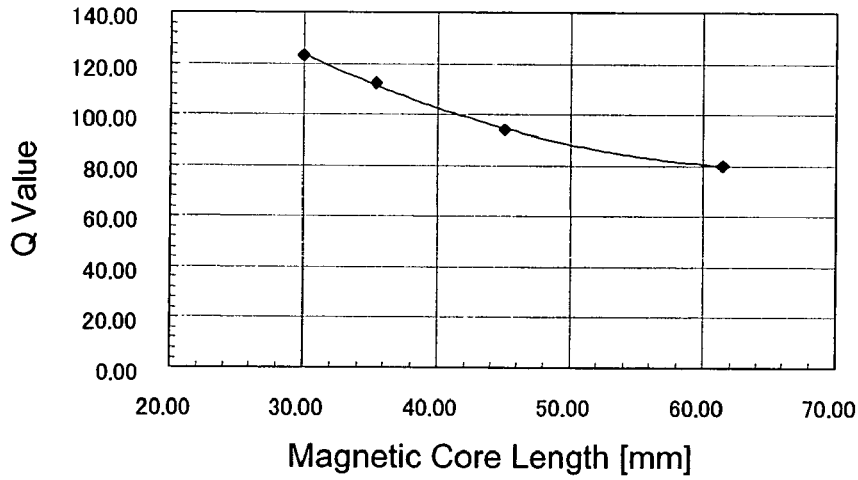
FIG. 9 is a graph showing the relationship between the magnetic core length of the induction coil and the Q value according to the embodiment of the present invention.

Next, an example is shown in FIG. 9 of changes in the Q value of the induction coil 3 when the axial length L of the magnetic core 3*b* is changed. Here, the winding 3*a* is provided by arranging 50 turns of litz wire, formed by bundling 28 thin wires of 0.08 mm in diameter, within a 24 mm-area in axial length. The size of the magnetic core 3*b* was all set to 8.5 mm in inner diameter and 13.5 mm in outer diameter. It is to be noted that although the outer diameter was varied from 14 mm to 11.5 mm, no description will be made in conjunction therewith because these variations resulted in almost the same characteristics.

As is clear from FIG. 9, 41 mm is the upper limit of the axial length L of the magnetic core 3*b* that brings the Q value of the induction coil 3 to 100 or more when the lamp is inserted in iron fixture of 85 mm in diameter.

From the above, it is preferred that the upper limit of the axial length L of the magnetic core 3*b* be set to 41 mm. To ensure that the axial length of the magnetic core 3*b* is 41 mm or less including variations—in consideration of 5% tolerance of the axial length of the magnetic core 3*b*, it is further preferred that the axial length of the magnetic core 3*b* be set to 39 mm or less. By setting the axial length L' of the winding 3*a* to 38 mm when the axial length L of the magnetic core 3*b* is 41 mm, it is possible to ensure that the axial length L of the magnetic core 3*b* is 41 mm or less even assuming that the tolerance of the axial length L of the magnetic core 3*b* is 5% and that the displacement between the centers of the winding 3*a* and the magnetic core 3*b* is 1 mm.

It is to be noted that while the driving frequency of the drive circuit 4 is set to 480 kHz in the present embodiment, a driving frequency is arbitrarily selected from the range from 50 kHz to 1 MHz. The starting voltage of the induction coil 3 required to initiate electric discharge of the lamp remains almost unchanged in the range from 50 kHz to 1 MHz, and the starting voltage for driving at 1 MHz, for example, is only about 5% lower than that at 480 kHz. Therefore, it can be safely said that as long as the driving frequency remains in the above range, the starting voltage is almost constant in relation to the driving frequency.

On the other hand, the Q value of the induction coil 3 is a function of frequency, and as the driving frequency is varied, the Q value varies even with the same induction coil 3. However, it was discovered that the tolerance range of the Q value capable of starting the lamp in the metal fixture of 85 mm in diameter, determined by the same method as before, remained almost unchanged in the range from 50 kHz to 1 MHz. For example, the lower limit of the Q value at the driving frequency of 1 MHz was found to be 93 or more. It is therefore possible to secure the same fixture startup performance in the 50 kHz–1 MHz range as long as the Q value is 100 or more—the range according to the present invention.

Figure 10:
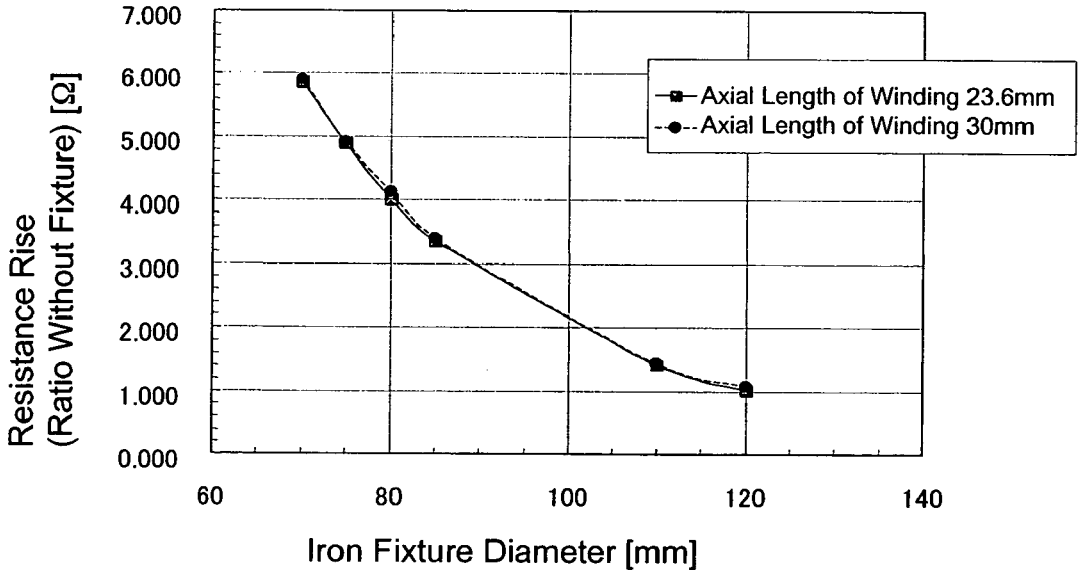
FIG. 10 is a graph showing an example of characteristics of the induction coil resistance value according to the embodiment of the present invention.

It is to be noted that the axial length L' of the winding 3*a*, although being set to 24 mm in the present embodiment, is not limited thereto. FIG. 10 shows resistance rise as the axial length L' of the winding 3*a* is varied when the induction coil 3 is inserted in the metal fixture. The size of the magnetic core 3*b* used here is 8.5 mm in inner diameter, 13.5 mm in outer diameter and 45 mm in axial length.

As is clear from the graph of FIG. 10, rise in resistance of the induction coil 3 turns out to be the completely same curve even if the axial length L' of the winding 3*a* is varied. That is, it is apparent that the characteristic change of the induction coil 3 during insertion into the metal fixture is determined by the size of the magnetic core 3*b*. Therefore, the same effect can be obtained even if the axial length of the winding 3*a* is varied as long as the size of the magnetic core 3*b* is in the range according to the present invention.

Figure 11:
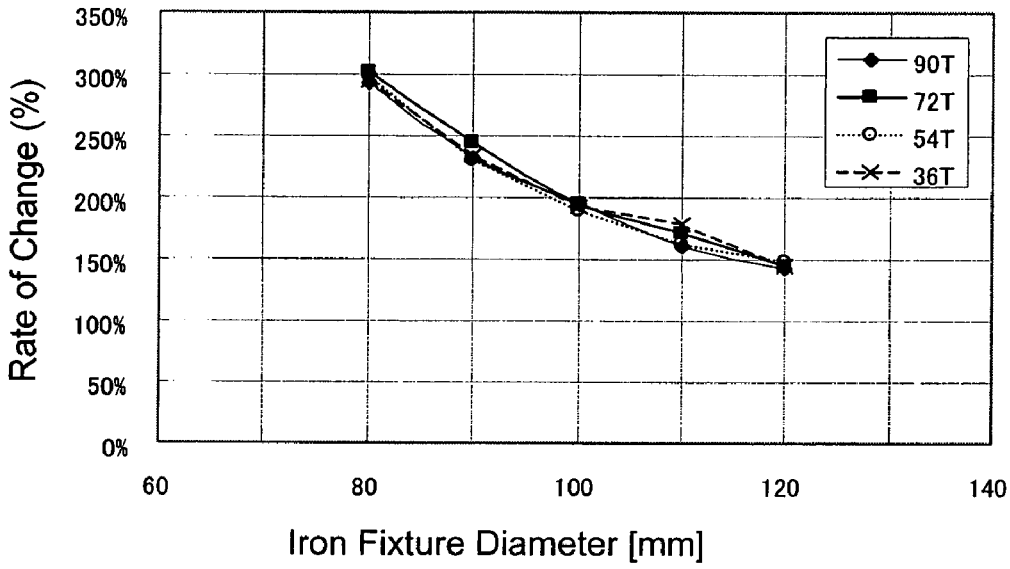
FIG. 11 is a graph showing an example of characteristics of the induction coil resistance value according to the embodiment of the present invention.

Further, while the number of turns of the winding 3*a* is 50 turns in the present embodiment, the effect of the present invention is not affected by the number of turns of the winding 3*a*. FIG. 11 shows the measured results of resistance change during insertion into the metal fixture with changed number of turns. As is clear from FIG. 11, when the number of turns is varied, the Q value turns out to be the completely same curve although the absolute value of resistance of the induction coil 3 changes. Therefore, the same remedial effect against metal fixture can be obtained as long as the size of the magnetic core 3*b* remains in the range according to the present invention. On the other hand, the winding 3*a* is not limited to litz wire, and the effect is the same even with single wire.

The material of the magnetic core 3*b* is not limited to ferrite. The material of the magnetic core 3*b* may be a metal-based magnetic material such as amorphous or Permalloy material, and further may be silicon steel in the case of a low frequency below 100 kHz. On the other hand, since the magnetic core 3*b* becomes extremely hot during lamp operation, it is preferred that the Curie temperature of the magnetic core 3*b* be 200° C. to 300° C. The reason is that while there is nothing wrong with using a material whose Curie temperature is 300° C. or more, if the temperature of the induction coil 3 reaches 300° C. or more, the insulation life of the coating of the winding 3*a* cannot last.

Figure 12:
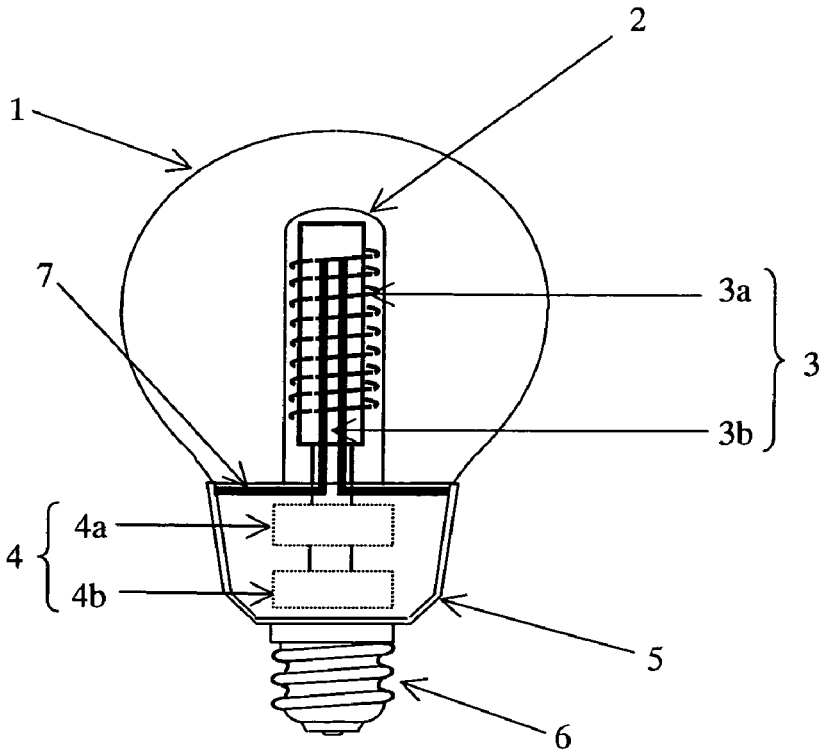
FIG. 12 is a schematic view showing another embodiment of the electrodeless discharge lamp according to the embodiment of the present invention.
Figure 13:
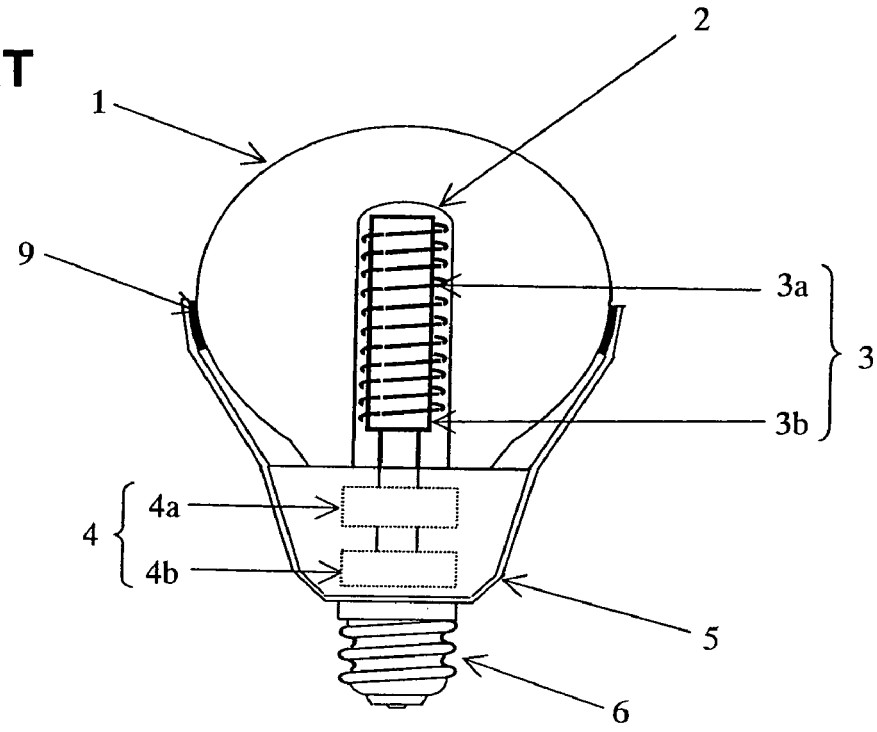
FIG. 13 PRIOR ART
FIG. 13 is a schematic view showing a conventional electrodeless discharge lamp.

On the other hand, a heat conducting member 7 may be provided to radiate heat of the magnetic core 3*b* as shown in FIG. 12. When the heat conducting member 7 is provided, it is preferred that the magnetic core 3*b* be made cylindrical, that part of the heat conducting member 7 be inserted into the cylinder and that the magnetic core 3*b* and the heat conducting member 7 be arranged within the cylinder such that they are partially in thermal contact with each other. The reason for this is to prevent the heat conducting member 7 from affecting magnetic flux generated from the induction coil 3 to the extent possible. Among most preferred materials for use as the heat conducting member 7 are metals having considerably high heat conductivity such as copper, brass and molybdenum. Highly heat-conducting ceramics such as alumina and aluminum nitride are also usable as the heat conducting member 7. In this case, it is necessary to make the heat conducting member 7 extremely thicker than with other metals, thus resulting in not only heavier product but also increased cost.

It is to be noted that a driving frequency beyond 1 MHz facilitates generation of electric discharge itself, allowing obtaining sufficient startability without using the present invention. Conversely, a driving frequency below 50 kHz requires considerably large power to maintain electric discharge and also leads to extremely deteriorated light emission efficiency, making such a frequency hardly practicable. The effect of the present invention is prominent at a driving frequency from 100 kHz to 700 kHz.

It is to be noted that the effect of the present invention is not limited to when the lamp is inserted into the iron reflecting mirror 8 in the present embodiment. Among materials of the reflecting mirror 8 and its similar fixture are assumably aluminum and aluminum-evaporated plastic, and any of these materials provides the effect of suppressing resistance rise. The reason is that mutual induction taking place between the reflecting mirror 8 and the induction coil 3 is not a phenomenon limited to such materials.

While the lamp according to the present embodiment has a shape of an electric bulb, the effect of the present invention is not limited to when the lamp has a shape of an electric bulb. It is to be noted, however, that the lamp having a shape of an electric bulb is often used as attached to fixture having a metallic reflecting mirror, thus allowing fully exerting the effect of the present invention.

The present invention is conveniently used in the field of lighting fixture operating on commercial power at relatively low driving frequency.

While the illustrative and presently preferred embodiment of the present invention has been described in detail herein, it is to be understood that the inventive concepts may be otherwise variously embodied and employed and that the appended claims are intended to be construed to include such variations except insofar as limited by the prior art.

This application is based on Japanese Patent Application No. 2003-323235 filed on Sep. 16, 2003, the entire contents of which are hereby incorporated by reference.

What is claimed is:

1. An electrodeless discharge lamp comprising:

a bulb including a substance for electric discharge sealed therein, the bulb having a reentrant portion protruding inwardly along a given direction;

an induction coil arranged in the reentrant portion, the induction coil having a magnetic core and a winding wound around the magnetic core; and a drive circuit for supplying the induction coil with a power from 50 kHz to 1 MHz, wherein the bulb has an outer diameter from 65 mm to 75 mm in a direction orthogonal to the given direction, and wherein the magnetic core has a length L in the given direction that is 1.05 times or more a length L' of the winding in the given direction, the length L being set to 41 mm or less.

2. The electrodeless discharge lamp according to claim 1, wherein the length L of the magnetic core is 1.07 times or more the length L' of the winding, the length L being set to 39 mm or less.

3. The electrodeless discharge lamp according to claim 1, wherein the length L of the magnetic core is set to 15 mm or more.

4. The electrodeless discharge lamp according to claim 1, wherein the bulb has a shape substantially axially symmetrical with respect to the given direction.

5. An electrodeless discharge lamp comprising:

a bulb including a substance for electric discharge sealed therein, the bulb having a reentrant portion protruding inwardly along a given direction;

an induction coil arranged in the reentrant portion, the coil having a magnetic core and a winding wound around the magnetic core; and a drive circuit for supplying the induction coil with power from 50 kHz to 1 MHz, wherein the bulb has an outer diameter from 65 mm to 75 mm in a direction orthogonal to the given direction, and wherein the induction coil has a Q value of 100 or more as measured with the induction coil positioned at the center in an iron-made cylinder having the diameter of 85 mm.

6. The electrodeless discharge lamp according to claim 1, wherein the distance between the centers of the winding and of the magnetic core is 1 mm or less.

7. The electrodeless discharge lamp according to claim 1, wherein the axial length of the winding is 38 mm or less.

8. The electrodeless discharge lamp according to claim 1, wherein the frequency of power supplied by the drive circuit is from 100 kHz to 700 kHz.

9. The electrodeless discharge lamp according to claim 1, wherein the winding is made of litz wire.

10. The electrodeless discharge lamp according to claim 1, wherein the sealed gas is krypton gas or a mixed gas of argon and krypton gases sealed in a pressure range from 40 Pa to 250 Pa.

11. The electrodeless discharge lamp according to claim 1, comprising a screw base for receiving commercial power, the electrodeless discharge lamp having a shape in the form of an electric bulb.

12. The electrodeless discharge lamp according to claim 5, wherein the distance between the centers of the winding and of the magnetic core is 1 mm or less.

13. The electrodeless discharge lamp according to claim 5, wherein the axial length of the winding is 38 mm or less.

14. The electrodeless discharge lamp according to claim 5, wherein the frequency of power supplied by the drive circuit is from 100 kHz to 700 kHz.

15. The electrodeless discharge lamp according to claim 5, wherein the winding is made of litz wire.

16. The electrodeless discharge lamp according to claim 5, wherein the sealed gas is krypton gas or a mixed gas of argon and krypton gases sealed in a pressure range from 40 Pa to 250 Pa.

17. The electrodeless discharge lamp according to claim 5, comprising a screw base for receiving commercial power, the electrodeless discharge lamp having a shape in the form of an electric bulb.

* * * * *

UNITED STATES PATENT AND TRADEMARK OFFICE

CERTIFICATE OF CORRECTION

PATENT NO. : 7,084,562 B2
APPLICATION NO. : 10/940044
DATED : August 1, 2006
INVENTOR(S) : Toshiaki Kurachi et al.

It is certified that error appears in the above-identified patent and that said Letters Patent is hereby corrected as shown below:

Title Page, item (56):

Under "References Cited", the inventors for U.S. Patent 6,768,254 should be -- Arakawa et al. --.

Signed and Sealed this

Nineteenth Day of December, 2006

JON W. DUDAS
*Director of the United States Patent and Trademark Office*